US008118622B2

(12) United States Patent
Chen

(10) Patent No.: US 8,118,622 B2
(45) Date of Patent: Feb. 21, 2012

(54) ELECTRICAL CONNECTOR DECREASING INSERTING FORCE

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/856,822

(22) Filed: Aug. 16, 2010

(65) Prior Publication Data

US 2011/0111637 A1 May 12, 2011

(30) Foreign Application Priority Data

Nov. 12, 2009 (CN) ..... 2009 2 0314546

(51) Int. Cl.
*H01R 11/22* (2006.01)

(52) U.S. Cl. ..... 439/857

(58) Field of Classification Search ..... 439/873, 439/856, 857, 660, 636
See application file for complete search history.

(56) References Cited

U.S. PATENT DOCUMENTS 3,656,093 A * 4/1972 Kinkaid ..... 439/872
5,599,213 A * 2/1997 Frommer et al. ..... 439/857
6,109,974 A * 8/2000 Kodaira ..... 439/682

* cited by examiner

*Primary Examiner* — Ross Gushi
(74) *Attorney, Agent, or Firm* — Wei Te Chung; Andrew C. Cheng; Ming Chieh Chang

(57) ABSTRACT

An electrical connector has a insulative housing defining a plurality of passageways and a plurality of contacts secured in the passageways. Each passageway has a mating slot and a pair of retaining slots located at two sides of the mating slot and communicated with the mating slot. Each contact defines a soldering tail and a pair of arm portions extending from the soldering tail and retained in the two retaining slots respectively, the pair of arm portions shift in and between the mating slot and the retaining slot in a first direction, a pair of contact portions integrally project oppositely from inner sides of the arm portions. Wherein the arm portions define shrink sections at a position thereof opposite to the contact portions so that the shrink sections space away from the retaining slots in a second direction perpendicular to the first direction. It can reduce inserting force and ensure electrical connecting performance of the electrical connector.

10 Claims, 6 Drawing Sheets

ELECTRICAL CONNECTOR DECREASING INSERTING FORCE

BACKGROUND OF THE INVENTION

1. Field of the Invention

The present invention generally relates to an electrical connector, and more particularly, to a novel structure of an electrical contact for reducing inserting force of a complementary contact.

2. Description of Related Art

Reasonable inserting force between an electrical connector and a complementary connector can ensure a good electrical connecting performance of the electrical connector assembly.

A socket electrical connector in industry includes an insulative housing defining a plurality of passageways and a plurality of contact secured in the passageways. Each contact defines a pair of contact portions receiving in the passageway and forming a contacting room therebetween for receiving a complementary contact portion. Each contact portion can move elastically when the complementary contact portion is inserted into the contacting room. Each passageway defines a retention slot for retaining the contact portion. If the interval between the retention slot and the contact portion is too large, it makes the contact portion shaken and influence electrical connecting performance of the electrical connector. If the interval between the retention slot and the contact portion is too small, it can increase inserting force of the electrical connector. Thus, an electrical connector with reasonable inserting force is desired to overcome the disadvantages of the related art.

Hence, the present invention is directed to solving this problem in the related art.

SUMMARY OF THE INVENTION

An object of the invention is to provide an electrical connector which has a plurality of contacts with reasonable inserting force.

In order to achieve the object set forth, an electrical connector has a insulative housing defining a plurality of passageways and a plurality of contacts secured in the passageways. Each passageway has a mating slot and a pair of retaining slots located at two sides of the mating slot and communicated with the mating slot. Each contact defines a soldering tail and a pair of arm portions extending from the soldering tail and retained in the two retaining slots respectively, the pair of arm portions shift in and between the mating slot and the retaining slot in a first direction, a pair of contact portions integrally project oppositely from inner sides of the arm portions. Wherein the arm portions define shrink sections at a position thereof opposite to the contact portions so that the shrink sections space away from the retaining slots in a second direction perpendicular to the first direction. It can reduce inserting force and ensure electrical connecting performance of the electrical connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
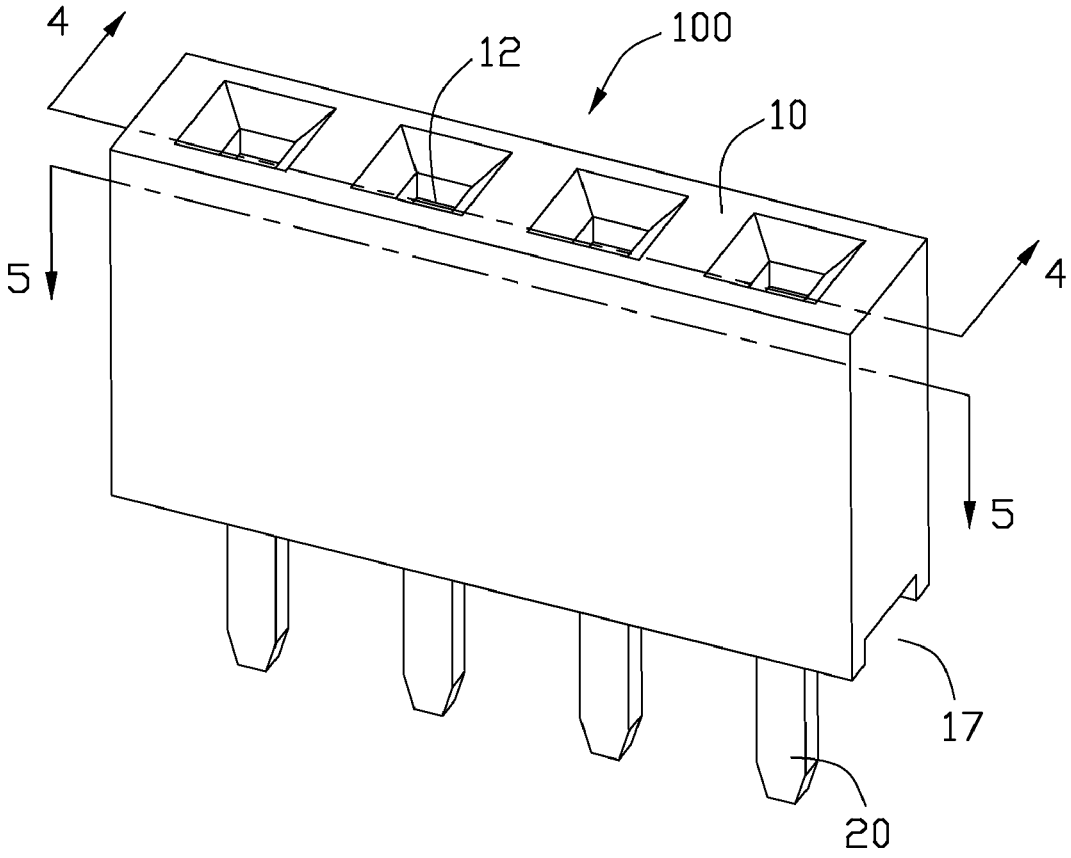
FIG. 1 is an assembled perspective view of an electrical connector of an embodiment of the present invention.
Figure 2:
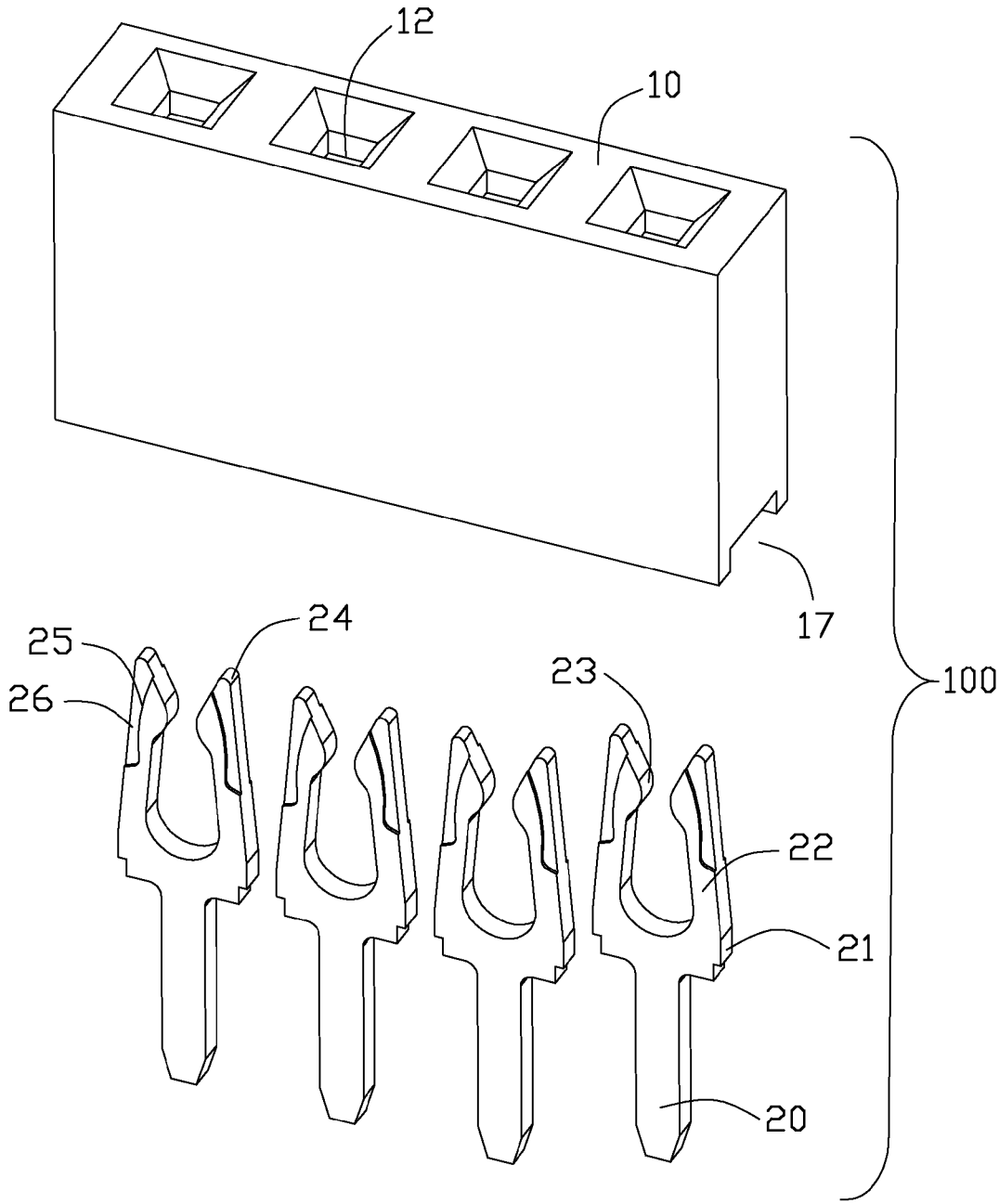
FIG. 2 is an exploded perspective view of the electrical connector as shown in FIG. 1.

Referring to FIGS. 1 and 2, an electrical connector 100 for mating with a complementary connector (not shown) in accordance with an embodiment of the present invention comprises an insulative housing 1 defining a plurality of receiving passageways 12 and a plurality of contacts 2 secured in the passageways 12.

Figure 3:
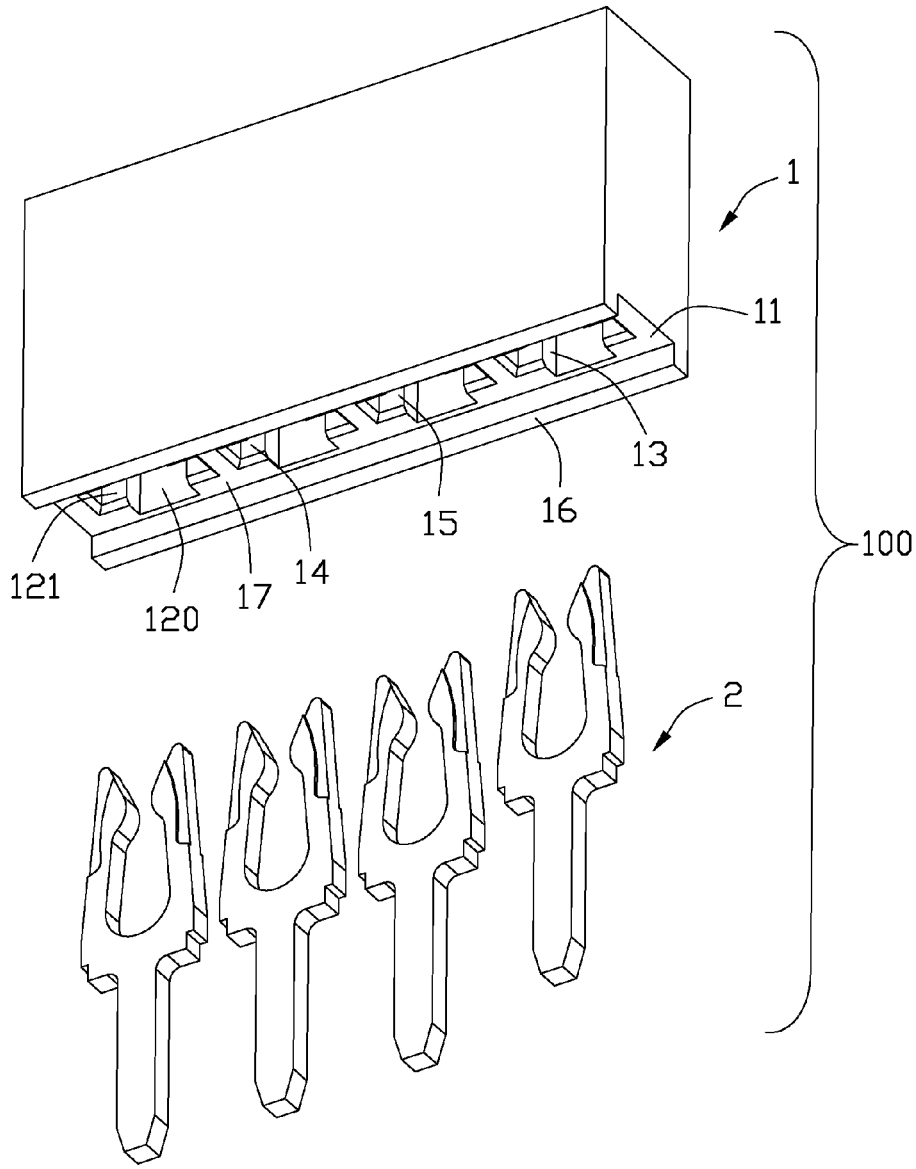
FIG. 3 is a view similar to FIG. 2, while taken from a different aspect.

Referring to FIGS. 2 and 3, the insulative housing 1 is substantially longitudinal and has a mating face 10 for confronting with the complementary connector and a bottom face 11 opposite to the mating face 10. The receiving passageways 12 extending through the mating face 10 and the bottom face 11 are in a row in a longitudinal direction of the insulative housing 1. Each receiving passageway 12 has a mating slot 120 and a pair of retaining slots 121 located at two sides of the mating slot 120 in a longitudinal direction of the insulative housing 1 and communicated with the mating slot 120. The mating slot 120 has two opposite inner faces 13 perpendicular to the longitudinal direction, from which the retaining slots 121 respectively extend sidewards. The retaining slot 121 extends downwardly through the bottom face 11 and has two opposite side faces 14 intersected with the inner faces 13. A first intersection 15 is directed with the inner face 13 and the side face 14. The insulative housing 1 defines two ribs 16 extending downwardly from two sides of the bottom face 11 along the longitudinal direction and a receiving room 17 between the two ribs 16. It can prevent the electrical connector 100 from turning up from a printed circuit board (not shown) when the electrical connector is welded on the printed circuit board.

Figure 4:
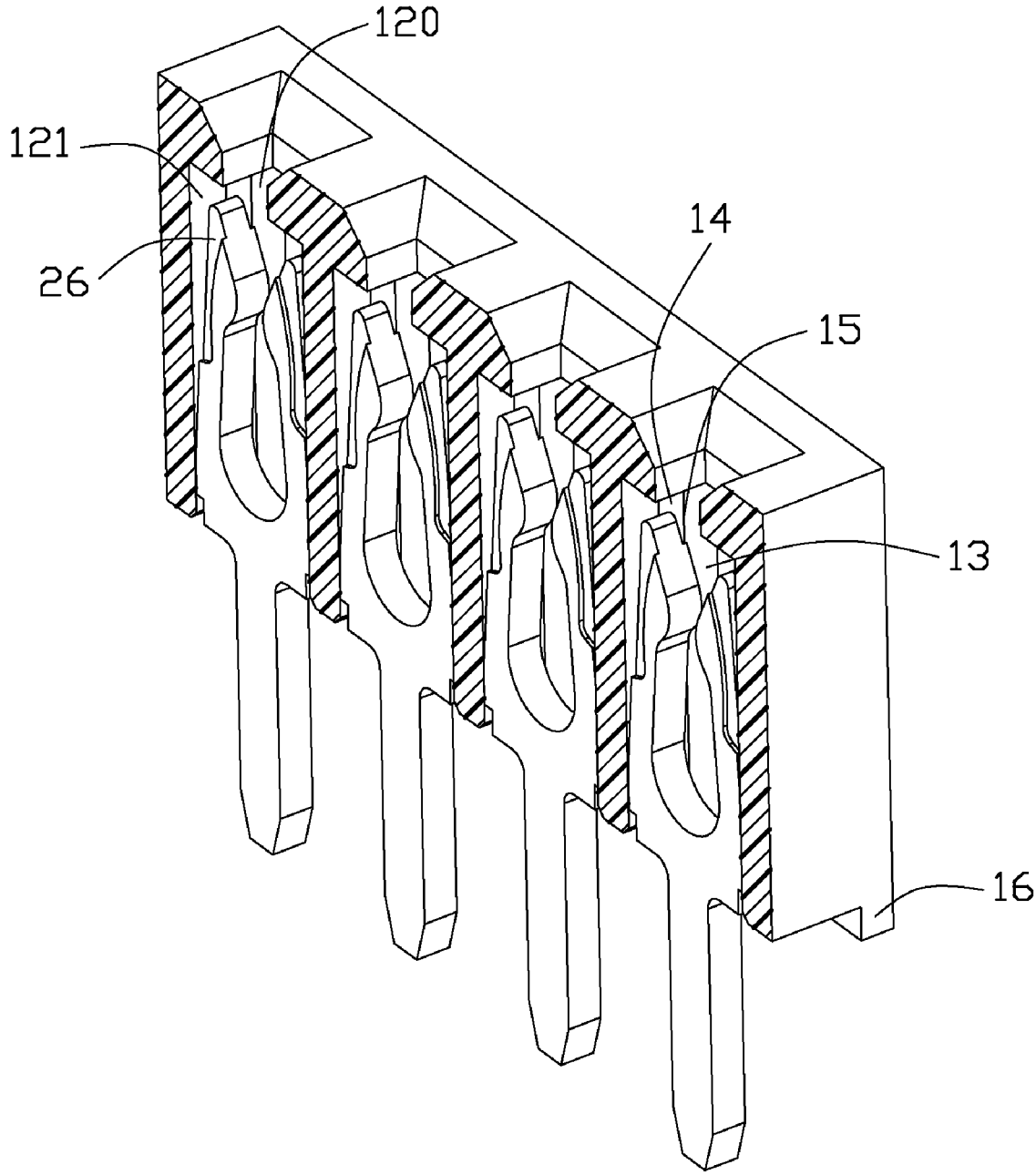
FIG. 4 is a cross-sectional view of the electrical connector taken along lines 4-4 in FIG. 1.
Figure 5:
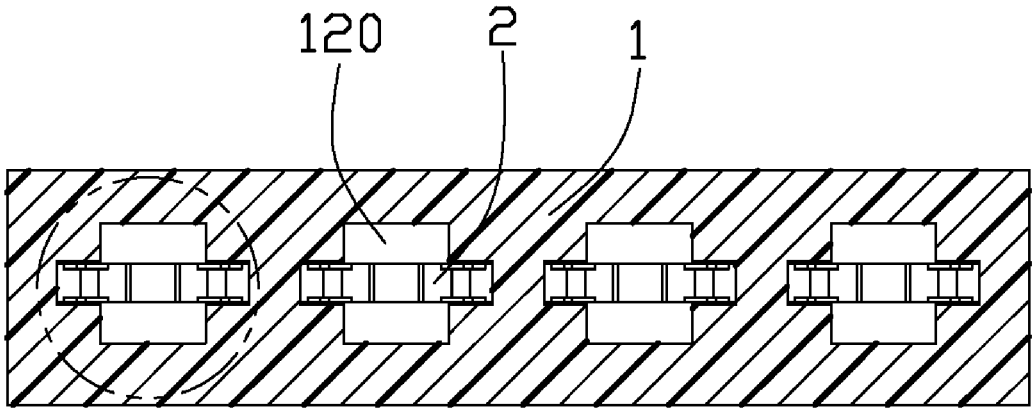
FIG. 5 is a cross-sectional view of the electrical connector taken along lines 5-5 in FIG. 1.
Figure 6:
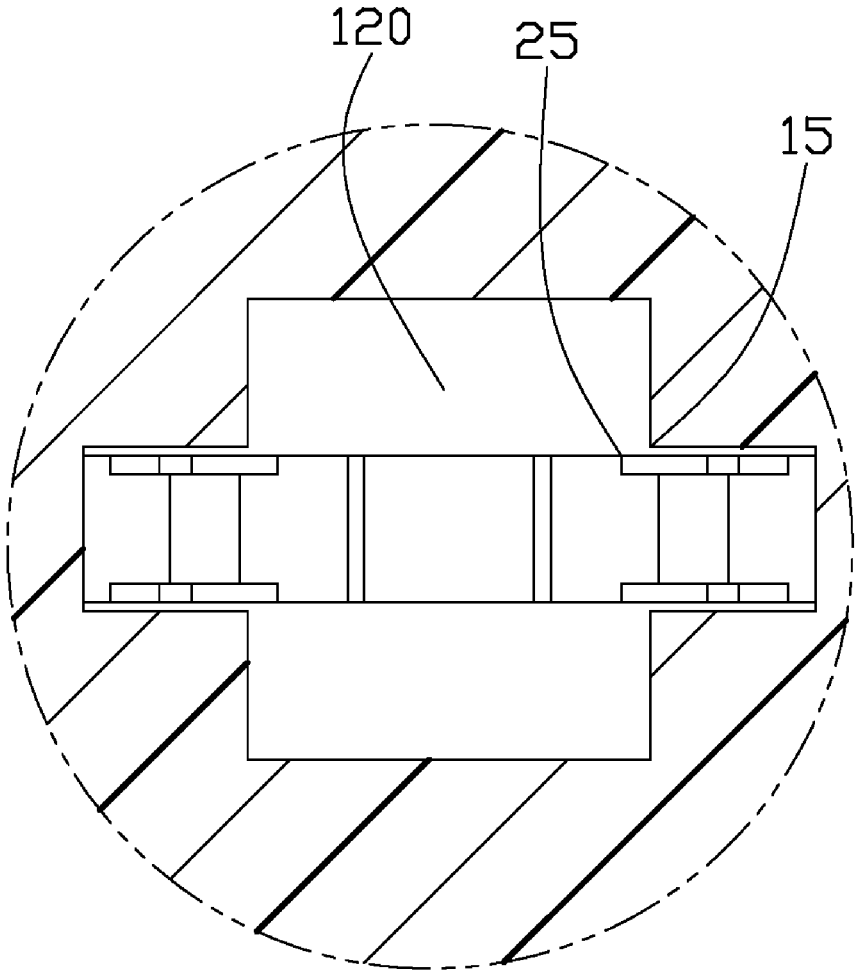
FIG. 6 is a partly-enlarged view of the electrical connector as shown in FIG. 5.

Referring to FIGS. 2 and 4, each contact 2 is secured in the passageway 12 of the insulative housing 1 from the bottom face 11 and has a soldering tail 20 for mounting on the printed circuit board outside the passageway 12. The part of the soldering tail 20 is in the receiving room 17 so as to prevent the housing 1 from turning up. A pair of arm portions 22 receiving in the passageway 12 extend upwardly from the soldering tail 20 and are retained in the two retaining slot 121 respectively. The pair of arm portions 22 shift in and between the mating slot 120 and the retaining slot 121 in a first direction. The pair of arm portions 22 forms a U-shaped contacting room for connecting with a complementary contact (not shown). A pair of contact portions 23 integrally project oppositely from inner lateral sides of the free ends of the arm portions 22 into the mating slot 120. Bottom ends or roots of the arm portions 22 are functioned as a retention portion 21, especially at the lateral outside thereof. The bottom ends of the arm portions are wider in the longitudinal direction so that the retention portion are fitly retained in the retaining slots 121 and the upper portion 24 of the arm portions are moveably received in the retention slots.

Referring to FIGS. 2 and 4-6, the upper portion 24 is far from the soldering tail 20 and near to the mating face 10. The contact portions 23 are defined at the inner lateral sides of the upper portions 24. Each upper portion 24 further defines a shrinking section 26 at the lateral outside of two opposite sides perpendicular to the inner lateral sides thereof in a form of recess through the free end of the arm portion and an outer lateral side opposite to the inner lateral side thereof, which result that the contact portions 23 are wider than the shrinking sections 24. The shrinking sections 26 are shorter than the arm portion 22. The shrink sections 26 at a position thereof opposite to the contact portions 23 so that the shrink sections 26 space away from the retaining slots 121 in a second direction perpendicular to the first direction. A second boundary 25 is directed with the recess and the contact portion 23. The second boundary 25 isn't beyond the first boundary 15 and locates in the mating slot 120, when the contact portions 23 move laterally to the retaining slot 121 (refer to FIG. 6). There is reasonable interval between the contact 2 and the retaining slot 121. So it provides reasonable inserting force between the contact 2 and the complementary contact and ensure reliable electrical connecting performance of the electrical connector 100.

Each contact portion 23 has a pre-determined thick in the second direction. If the contact portion 23 is wider than the retaining slot 121, a face directed with the shrinking section 26 and the contact portion 23 is jointed on the inner face 13, it can reduce inserting force of the complementary. If the contact portion 23 is equal to the retaining slot 121, it also can reduce intervening between the contact portion 23 and the retaining slot 121. If the contact portion 23 is narrower than the retaining slot 121, even if the contact portion can shake, it improve the inserting performance of the complementary contact.

What is claimed is:

1. An electrical connector, comprising:

a longitudinal insulative housing having a plurality of receiving passageways, each receiving passageway having a mating slot and a pair of retaining slots located at two opposite sides of the mating slot and communicated with the mating slot;

a plurality of contacts secured in the receiving passageways of the housing, each contact defining a soldering tail and a pair of arm portions with roots thereof secured in the retaining slots, the pair of arm portions shift in and between the mating slot and the retaining slot in a first direction, a pair of contact portions integrally project oppositely from inner sides of the arm portions;

wherein the arm portions define shrink sections by reducing thicknesses of the arm portions at a position thereof opposite to the contact portions so that the shrink sections space away from the retaining slots in a second direction perpendicular to the first direction; wherein the shrinking section is defined in a form of recess which extends through a free end of the arm portions and an outer lateral side opposite to the inner side of the contact portion.

2. The electrical connector as claimed in claim 1, wherein said insulative housing has a mating face and a bottom face opposite to the mating face beyond which the solder portions extend, the receiving passageways extend through the mating face and the bottom face, the upper portions of the arm portions of the contacts are near to the mating face.

3. The electrical connector as claimed in claim 2, wherein each pair of arm portions is configured of a U shape.

4. The electrical connector as claimed in claim 3, wherein the insulative housing defines two longitudinal ribs at the bottom face at two sides of the plurality of receiving passageways.

5. An electrical contact, comprising:

a soldering tail;

a U shape portion with a pair of spaced arm portions joined with the soldering tail at bottom ends thereof;

a pair of contact portion defined at upper portions of the arm portion, which face to each other;

the U shape portion of each contact has a uniform thickness except for a shrinking portion, the shrinking section is defined in a recess form which runs through a lateral surface of the upper portion opposite to a face from which the contact portion projects.

6. The electrical contact as claimed in claim 5, wherein the bottom ends function as a retention portion of the contact.

7. An electrical connector comprising:

an insulative housing defining a plurality of passageways extending inwardly along a direction from a front mating face of the housing;

a pair of retention slots communicatively formed by two sides of each of said passageway along a second direction perpendicular to said first direction in a cross-sectional view, each of said retention slots defining a corresponding confrontation face communicating with the corresponding passageway in said second direction, and a pair of retention faces located beside said confrontation face and facing toward each other in a third direction perpendicular to both said first direction and said second direction;

a plurality of terminals disposed in the corresponding passageways respectively, each of said terminals defining a U-shaped configuration with a rear retention portion snugly received in the corresponding pair of retention slots, a pair of front contacting arm portions extending from the rear retention portion;

an inner space defined between the pair of contacting arm portions being adapted to receive a corresponding counter contact of a complementary connector therein while an outer space located beside the contacting arm portion and confronting, along the second direction, the confrontation face in each corresponding passageway in the housing, being adapted to allow the contacting arm portion outward deflected toward said corresponding confrontation face; wherein the rear retention portion intimately confronts the retention faces in said third direction while an upper portion of each of the pair of the front contacting arm portions is substantially spaced from the retention faces in said third direction when the front contacting arm portion is outwardly deflected toward the corresponding confrontation face; wherein an inner side of the front contacting arm portion keeps a same thickness with the rear retention portion for assuring proper strength thereof.

8. The electrical connector as claimed in claim 7, wherein an outer side of the front contacting arm portion is thinned to leave a space with the corresponding retention faces when the front contacting arm portion is outwardly deflected toward the corresponding confrontation face.

9. The electrical connector as claimed in claim 8, wherein a boundary between the inner side and the outer side of the front contacting arm portion extends curvedly.

10. The electrical connector as claimed in claim 9, wherein each of said terminal is configured to be inserted into the corresponding passageway forwardly form a rear face of the housing, and the housing defines a plurality of narrowed front openings in the front mating face to protect the corresponding passageways, respectively, so as to protectively hide a pair of thinned tips of said pair of contacting arm portions therebehind.

* * * * *